US012359531B2

(12) United States Patent
Boyd et al.

(10) Patent No.: US 12,359,531 B2
(45) Date of Patent: Jul. 15, 2025

(54) CHOKE MECHANISM FOR A LUBRICATOR

(71) Applicant: FLOWCO PRODUCTION SOLUTIONS, LLC, Spring, TX (US)

(72) Inventors: Garrett S. Boyd, Granbury, TX (US); Darrell Mitchum, Oakhurst, TX (US)

(73) Assignee: Flowco MasterCo LLC, Houston, TX (US)

( * ) Notice: Subject to any disclaimer, the term of this patent is extended or adjusted under 35 U.S.C. 154(b) by 0 days.

(21) Appl. No.: 18/775,704

(22) Filed: Jul. 17, 2024

(65) Prior Publication Data

US 2024/0368964 A1 Nov. 7, 2024

Related U.S. Application Data

(63) Continuation of application No. 18/128,784, filed on Mar. 30, 2023, now Pat. No. 12,065,903.

(51) Int. Cl.
*E21B 34/02* (2006.01)
*E21B 34/14* (2006.01)

(52) U.S. Cl.
CPC ..... *E21B 34/025* (2020.05); *E21B 34/142* (2020.05)

(58) Field of Classification Search
CPC ..... E21B 34/025
See application file for complete search history.

(56) References Cited

U.S. PATENT DOCUMENTS

| | | | | |
|---|---|---|---|---|
| 2,943,640 | A * | 7/1960 | James | E21B 43/14 138/45 |
| 3,504,695 | A * | 4/1970 | Rogers | E21B 43/122 137/340 |
| 9,702,215 | B1 * | 7/2017 | Murphy | E21B 34/04 |
| 11,208,874 | B2 | 12/2021 | Murdoch | |
| 12,065,903 | B1 * | 8/2024 | Boyd | E21B 34/025 |
| 2014/0020909 | A1 * | 1/2014 | McKeon | F16K 31/50 166/91.1 |
| 2022/0025733 | A1 * | 1/2022 | Babler | F16K 1/38 |
| 2022/0349280 | A1 * | 11/2022 | Brewer | F04B 47/12 |

FOREIGN PATENT DOCUMENTS

CN 107701141 A 2/2018

* cited by examiner

*Primary Examiner* — Matthew R Buck
(74) *Attorney, Agent, or Firm* — Jason P. Mueller; FisherBroyles, LLP

(57) ABSTRACT

A lubricator and plunger catcher used in conjunction with an oil or gas well includes a manifold positioned between the wellhead and the plunger catcher. The manifold includes a plunger passageway that extends from the bottom of the manifold to the top of the manifold, with the plunger catcher being mounted to the top of the manifold. The manifold also includes a production passageway through which oil or gas leaving the wellhead is routed. A choke mechanism for at least partially blocking the production passageway is provided on the manifold to selectively vary the volume of the oil or gas leaving the wellhead that is routed through the plunger catcher. This, in turn, can selectively vary a force imparted to a plunger by the oil or gas leaving the wellhead to ensure the plunger is fully seated in the catcher when it arrives at the wellhead.

20 Claims, 10 Drawing Sheets

CHOKE MECHANISM FOR A LUBRICATOR

This application is a continuation of U.S. patent application Ser. No. 18/128,784, filed Mar. 30, 2023, the content of which is incorporated herein by reference.

BACKGROUND OF THE INVENTION

The present disclosure relates to a plunger catcher mechanism that receive, holds and releases a plunger used in oil and gas wells. More specifically, the present disclosure relates to a choke mechanism that can be used to ensure that when a plunger arrives at a wellhead, the plunger is fully seated in the catcher mechanism.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION OF THE INVENTION

Figure 1:
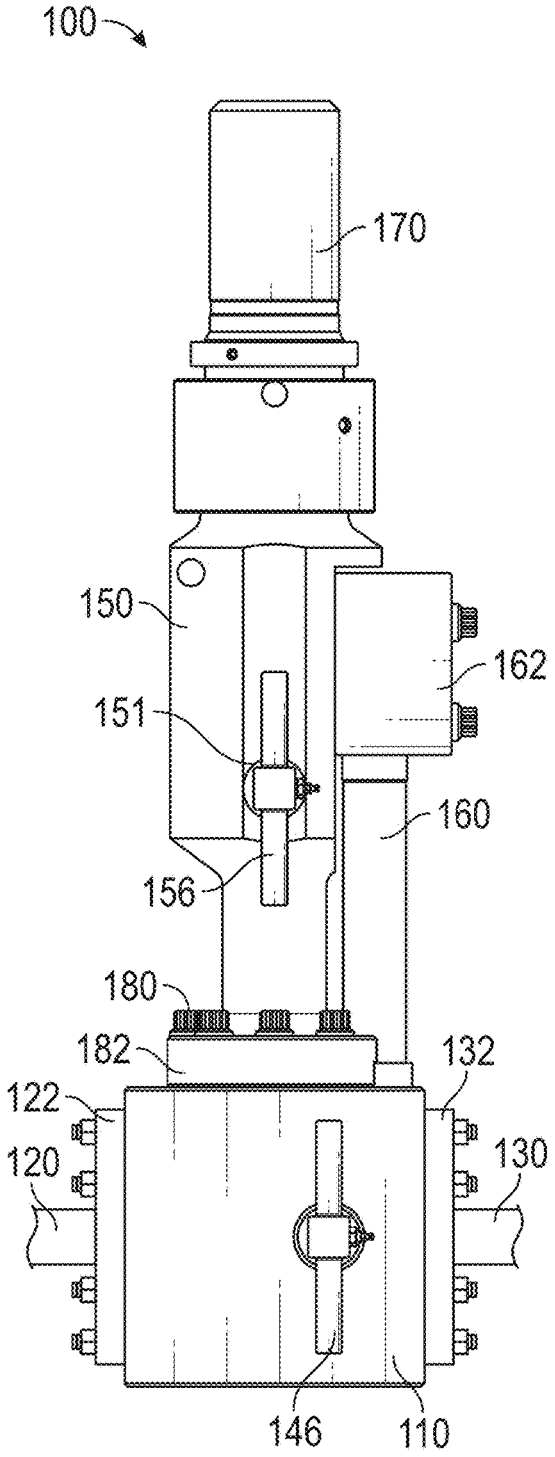
FIG. 1 is a front view of a manifold and plunger catcher assembly that includes a manually operated choke mechanism.
Figure 2:
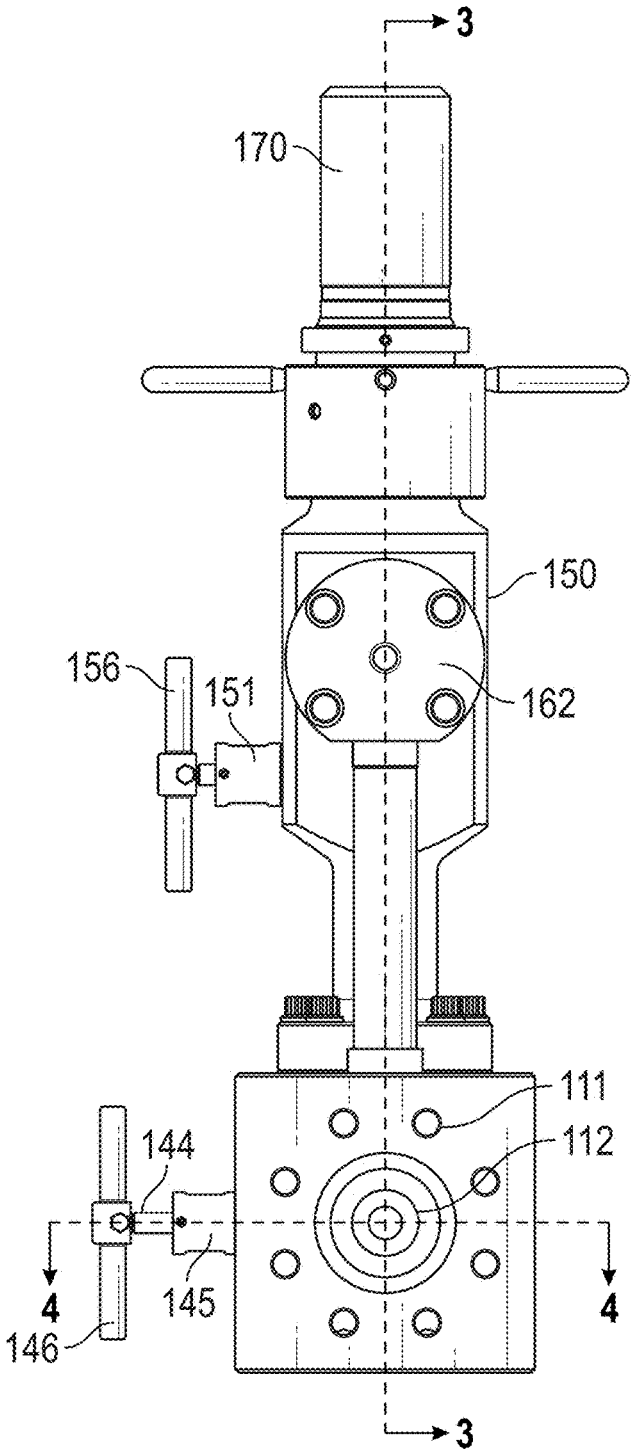
FIG. 2 is a right-side view of the manifold and plunger catcher assembly illustrated in FIG. 1.

The present disclosure is concerned with plunger catcher mechanism that is configured to hold and release a plunger used in oil and gas wells. As is well known to those of skill in the art, a manifold can be mounted on top of an oil or gas well, and a plunger catcher mechanism is then mounted on top of the manifold. Oil or gas produced by the well is routed through the manifold to a production line that typically leads to a collection tank.

When the downhole pressure of an oil or gas well is no longer high enough to force oil to gas to the surface at a satisfactory flow rate, one can employ a plunger to help bring oil or gas to the surface. A plunger is a device that is configured to freely descend and ascend within a well bore. The plunger operates to restore production to a well having insufficient pressure to lift the fluids to the surface. Some embodiments are configured as a "bypass" plunger, which may include a self-contained valve—also called a "dart" or a "dart valve"—to control the descent and ascent. Typically the valve is opened to permit fluids in the well to flow through the valve and passages in the plunger body as the plunger descends through the well. Upon reaching the bottom of the well, the valve is closed, converting the plunger into a piston by blocking the passages that allow fluids to flow through the plunger. With the plunger converted to a piston, blocking the upward flow of fluids or gas, pressure in the fluid below the bypass plunger gradually increases until the pressure is sufficient to lift the plunger and the column of fluid in the well bore located above the bypass plunger to the surface. As fluid above the bypass plunger arrives at the surface, the fluid is routed by the manifold to a production line. While the above description applies to bypass plungers, other types of plungers can also be used to help restore production to an oil or gas well.

When a plunger arrives at the surface, it passes through the manifold and into a plunger catcher mounted on top of the manifold. FIGS. 1-4 illustrate an example of a manifold and plunger catcher mechanism.

As illustrated in FIGS. 1-4, a manifold 110 is attached to the top of a well bore such that a plunger passageway 116 running from the bottom of the manifold 110 to the top of the manifold 110 is aligned with the well bore. While a plunger is ascending the well bore, pushing a column of fluid upward, the fluid is routed through the manifold 110 to a production passageway 118 that leads to a production outlet aperture 112 on a sidewall of the manifold 110. A production outlet line 130 is coupled to the sidewall of the manifold 110 by a production fixture 132. The fluid leaving the well bore is routed through the production outlet line 130 to a collection tank (not shown).

Figure 3A:
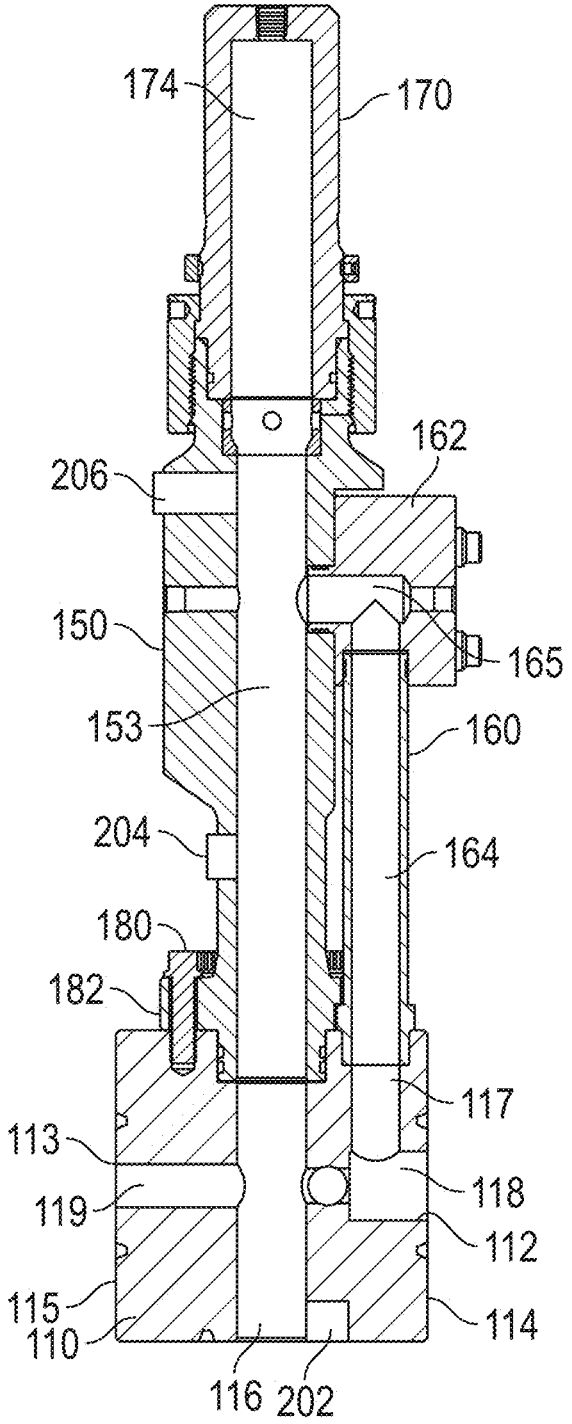
FIG. 3A is a cross-sectional view of the manifold and plunger catcher assembly illustrated in FIGS. 1 and 2 taken along section line 3-3 in FIG. 2 when no plunger is present in the plunger catcher.

As illustrated in FIG. 3A, an instrumentation passageway 119 in the manifold 110 leads to an instrumentation outlet aperture 113 on another sidewall of the manifold 110. As illustrated in FIG. 1, an instrumentation outlet line 120 is coupled to the sidewall of the manifold 110 by an instrumentation fixture 122. Fluid leaving the well bore can be routed to various sensors or instruments via the instrumentation outlet line 120.

As illustrated in FIG. 3A, fluid leaving the well bore can also be routed through the plunger passageway 118 to a hollow receiving bore 153 of the plunger catcher 150. The plunger catcher 150 is mounted on top of the manifold 110 by a catcher flange 182 and bolts 180. Fluid entering the hollow receiving bore 153 can then travel into an internal passageway 165 of a return line fixture 162 that is mounted onto a side of the plunger catcher 150. The fluid then travels down the interior passageway 164 of a return line 160 and into a return passageway 117 that is provided inside the manifold 110. The fluid then joins with fluid in the production passageway 118, which is routed into the production outlet line 130.

Fluid exiting the well bore is deliberately provided with this return circuit so that as a plunger leaves the well bore, passes through the manifold 110 and then travels up into the hollow receiving bore 153 of the plunger catcher 150, the fluid located above the plunger will be able to travel through the return circuit and into the production outlet line 130. If the return circuit were not provided, there would be nowhere for the fluid above the plunger to go, which would mean the plunger would be prevented from entering the hollow receiving bore 153 of the plunger catcher 150. In addition, by ensuring that there is a steady flow of fluid through this return circuit, the momentum of the fluid combined with the upward momentum of the plunger itself ensures that the plunger travels all the way up into the plunger catcher 150.

A holder mechanism 151 of the plunger catcher 150 is used to hold and release a plunger that travels up into the plunger catcher 150. A handle 156 of the holder mechanism 151 could be used to manually operate or adjust the plunger holder 151.

Figure 3B:
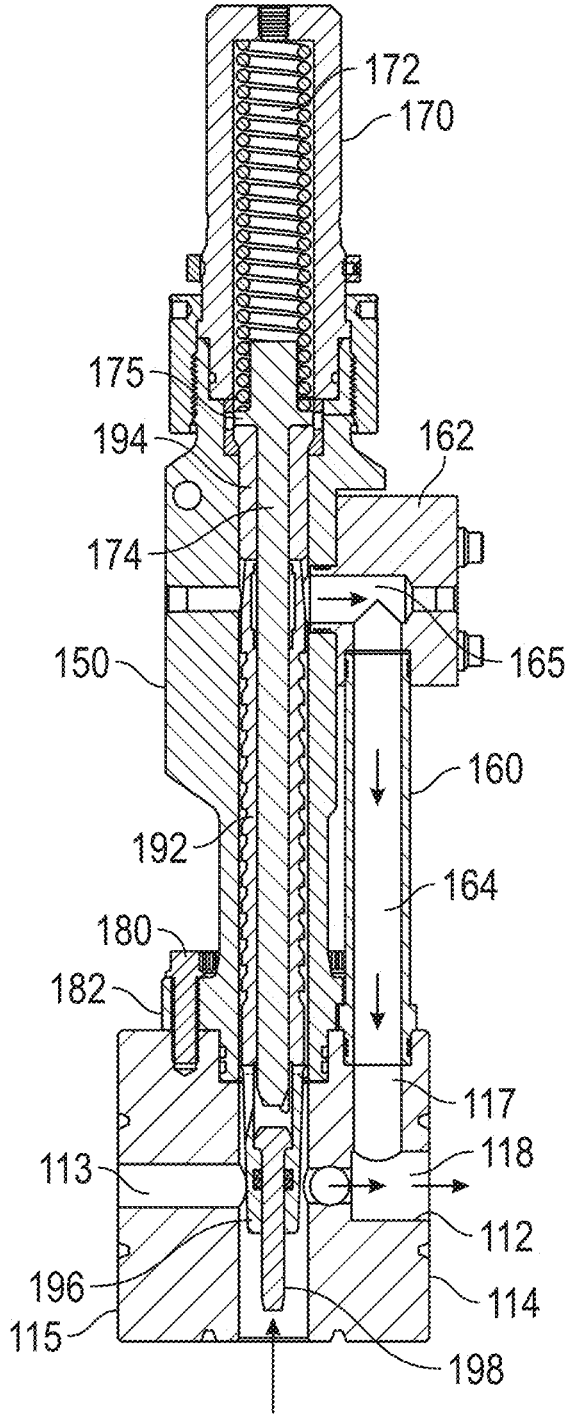
FIG. 3B is a cross-sectional view of the manifold and plunger catcher assembly illustrated in FIGS. 1 and 2 taken along section line 3-3 in FIG. 2 with a plunger located in the plunger catcher.

FIG. 3B illustrates a plunger 192 after it has been fully seated in the plunger catcher 150. The plunger 192 illustrated in FIG. 3B is a bypass plunger. However, the technology disclosed herein could be used in conjunction with any sort of plunger.

As illustrated in FIG. 3A, an arrival bumper spring 172 is mounted in the lubricator spring housing 170 of the plunger catcher 150. A shoulder 175 of a reset rod 174 bears against the lower part of the arrival bumper spring 172. The reset rod 174 extends downward into the hollow receiving bore 153 of the plunger catcher 150. As the plunger 192 moves upward into the hollow receiving bore 153 of the plunger catcher 150, the lower end of the reset rod 174 enters the hollow interior of the plunger 192. Further upward movement of the plunger 192 results in the reset rod extending deeper into the interior of the plunger 192 until the lower end of the reset rod 174 hits the top of a valve dart 198, pushing the valve dart 198 downward to a reset position. Once the valve dart 198 has been pushed into the reset position, fluid can travel through the interior of the plunger 192, which allows the plunger 192 to descend back to the bottom of the well bore.

As the upper end 194 of the plunger 192 arrives at the top of its travel, the upper end 194 of the plunger 192 hits the shoulder 175 of the reset rod 174. The shoulder 175 of the reset rod 174 bears against the lower end of the arrival bumper spring 172. The arrival bumper spring 172 operates to help arrest upward movement of the plunger 192 in a controlled matter, limiting any potential damage to the plunger 192 or the plunger catcher 150 due to the impact of the plunger 192 when it arrives and stops inside the plunger catcher 150.

In a well that has little pressure, which is the type of well where plungers are employed, the upward flow of the fluid may not be sufficient to cause the plunger 192 to move upward enough to fully seat in the plunger catcher 150. This can result in a stuck condition, where the plunger 192 blocks the flow of fluid out of the production passageway 118 of the manifold. Also, because the plunger 192 does not travel sufficiently far enough upward into the plunger catcher 150, the reset rod 174 cannot operate to push the valve dart 198 into the reset position. As a result, the passageways through the interior of the plunger 192 are not opened and the plunger 192 cannot travel back down to the bottom of the well bore.

The present application discloses a choke mechanism that is mounted on the manifold 110 and which operates to increase the flow rate of fluid through the return circuit that travels through the hollow receiving bore 153 and return line 160 of the plunger catcher 150. The increased the flow rate of fluid through this return circuit helps to preserve the upward momentum of the plunger 192 when it arrives at the top of the well bore, thereby helping the plunger 192 to move fully upward into the plunger catcher 150.

Figure 4:
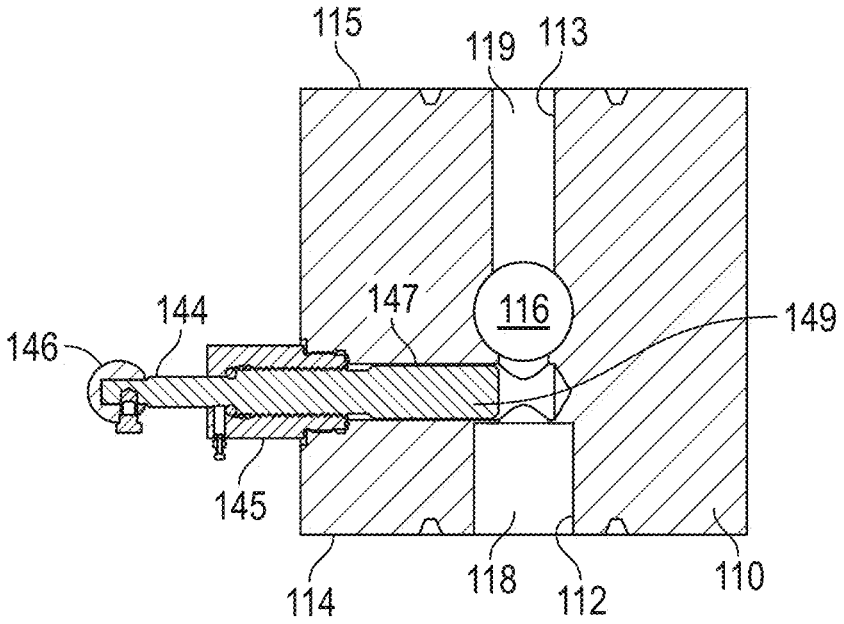
FIG. 4 is a cross-sectional view of the manifold of the manifold and plunger catcher assembly illustrated in FIGS. 1 and 3 taken along section line 4-4 in FIG. 2.
Figure 5:
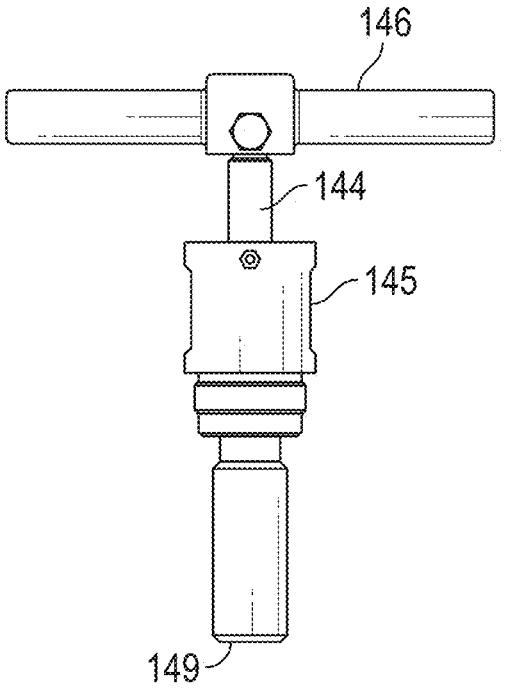
FIG. 5 illustrates a manually operated actuator of a choke assembly of the manifold of the manifold and plunger catcher assembly illustrated in FIGS. 1 and 2.
Figure 6:
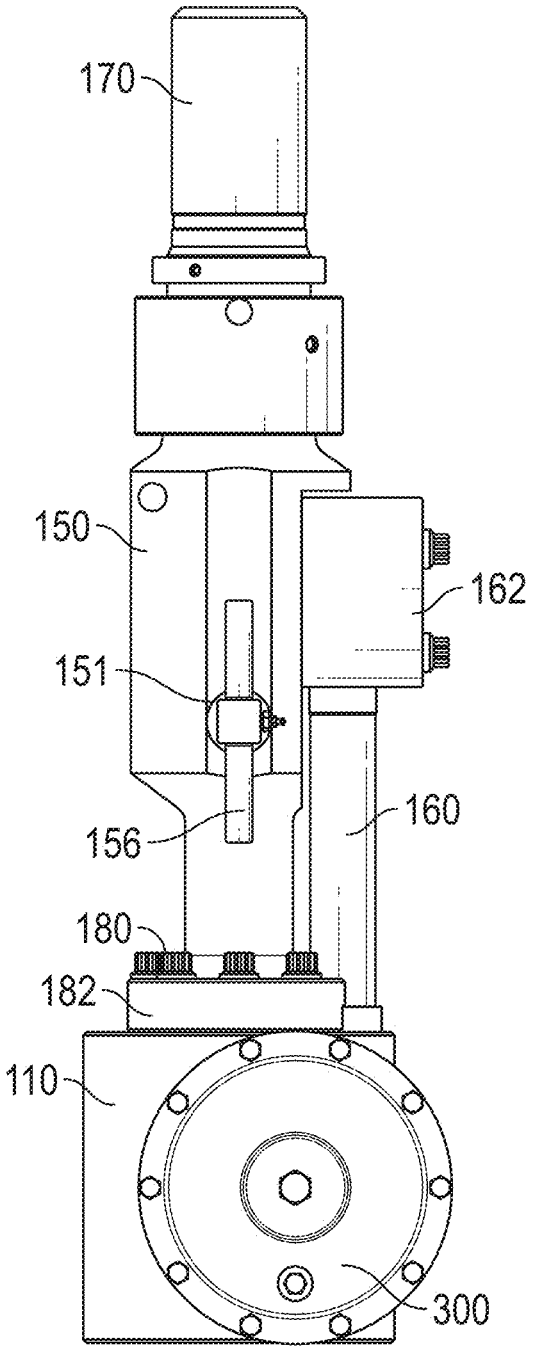
FIG. 6 is a front view of a manifold and plunger catcher mechanism that includes a pneumatic or hydraulically operated choke mechanism.
Figure 7:
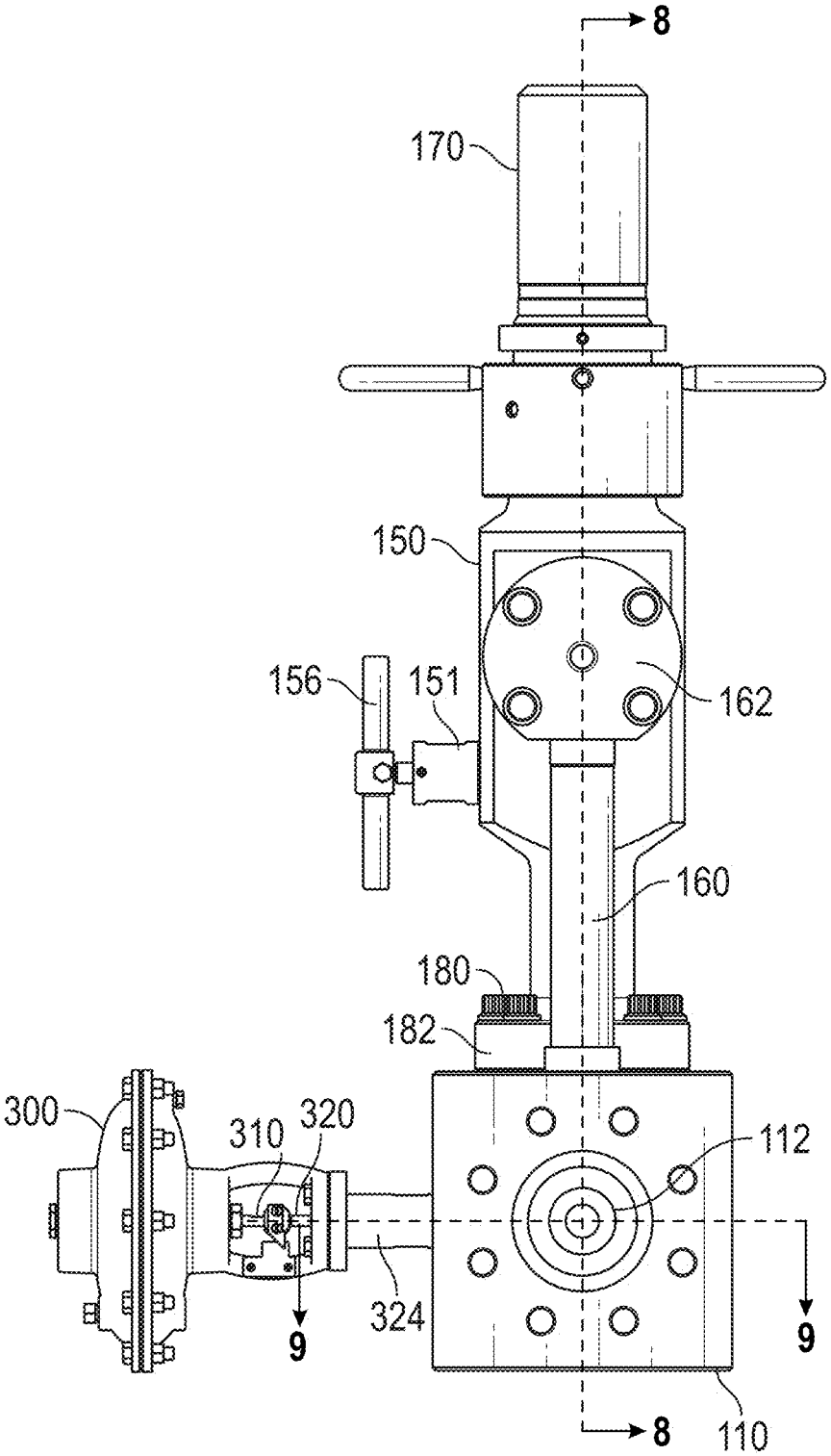
FIG. 7 is a right-side view of the manifold and plunger catcher mechanism illustrated in FIG. 6.
Figure 8:
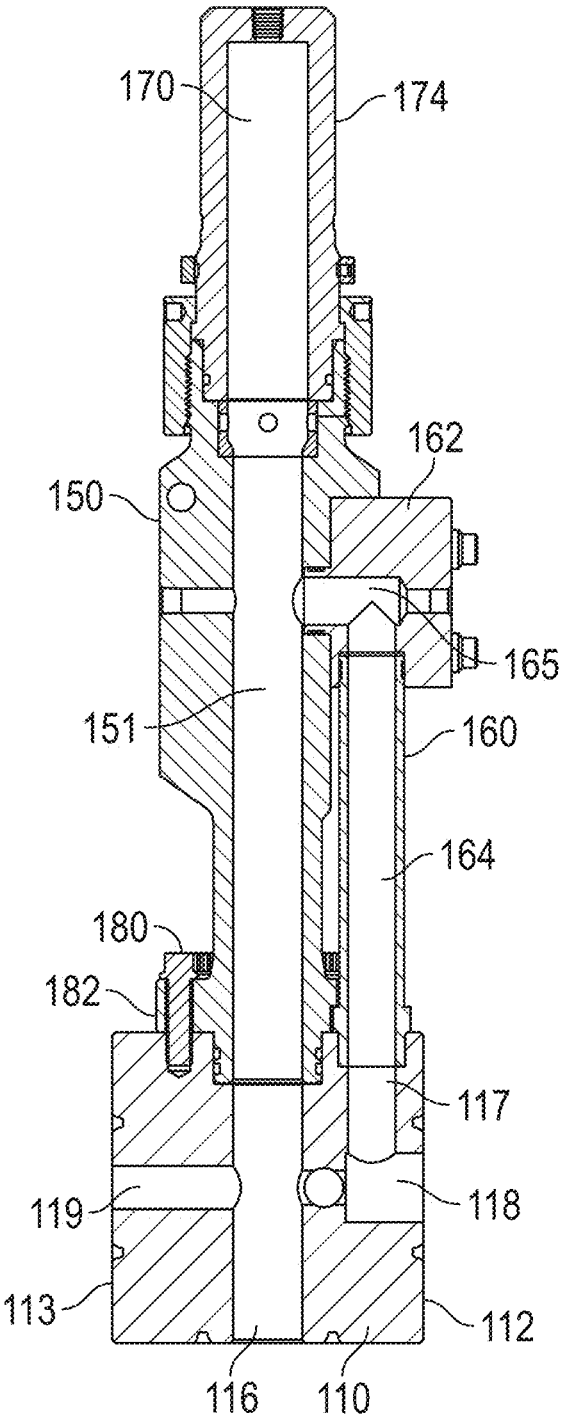
FIG. 8 is a cross-sectional view of the manifold and plunger catcher mechanism illustrated in FIGS. 6 and 7 taken along section line 8-8 in FIG. 7.

In a first embodiment as illustrated in FIGS. 1-5, the choke mechanism includes a choke member 147 that is slidably mounted in a choke passageway 113 of the manifold 110. As illustrated in FIGS. 3A, 3B and 4, the choke passageway 113 communicates with the production passageway 118 of the manifold 110. A choke mount collar 145 is mounted to the exterior of the manifold, and internal threads on the choke mount collar 145 engage external threads on a middle portion of the choke member 147. A handle 146 is attached to a proximal end 144 of the choke member 147. By turning the handle 146 clockwise and counterclockwise, one can cause the choke member 147 to rotate, and the internal threads on the choke mount collar 145 and external threads on the choke member 147 convert rotational motion of the chock member into axial movement of the choke member 147 along the choke passageway 113 of the manifold 110. This allows one to cause the distal end 149 of the choke member 147 to protrude into the production passageway 118 of the manifold 110.

When the distal end 149 of the choke member 147 protrudes into the production passageway 118, partially blocking the production passageway 118, more of the fluid exiting the well bore is routed through the return circuit that passes through the plunger catcher 150. As perhaps best seen in FIGS. 3A and 3B, fluid leaving the return circuit and arriving back at the manifold 110 will enter the production passageway 118 on the downstream side of the distal end 149 of the choke member 147. Thus, by selectively advancing and withdrawing the distal end 149 of the choke member 147 into and out of the production passageway 118, one can selectively vary the flow rate of fluid leaving the well bore that is routed through the return circuit passing through the plunger catcher 150.

If the flow rate of fluid leaving the well bore is not sufficient to cause a plunger to fully seat in the plunger catcher 150, one can advance the distal end 149 of the choke member 147 into the production passageway 118, thereby partially blocking the production passageway 118. This serves to increase the flow rate of fluid through the return circuit, which helps to ensure that the plunger will travel fully up into the plunger catcher 150. If pressure in the well increases such that the normal flow rate of fluid leaving the well bore is sufficient to cause the plunger to fully seat in the plunger catcher 150, the choke member 147 can be fully withdrawn from the production passageway 118, which helps to maximize flow out of the well into a collection tank.

The manifold 110 and/or the plunger catcher 150 may include one or more sensors that are used to determine the location and movements of a plunger. For example, an arrival sensor 202 may be mounted on the manifold 110. The arrival sensor 202 would output an arrival signal when a plunger emerges from the well bore and passes into the plunger passageway 116 of the manifold 110. Likewise, an arrival sensor 204 may be provided on the plunger catcher 150. The arrival sensor 204 on the plunger catcher 150 outputs an arrival signal when a plunger is located partway in the hollow receiving bore 153. Further, a seated sensor 206 could be located near the upper end of the hollow receiving bore 153 of the plunger catcher. The seated sensor 206 outputs a seated signal when a plunger is fully seated in the plunger catcher 150.

A controller coupled to the arrival sensors 202, 204 and the seated sensor 206 could determine whether a plunger is not fully seating in the plunger catcher 150 upon arriving at the surface. For example, if the controller notes that the seated sensor 206 did not output a seated signal shortly after one or both of the arrival sensors 202, 204 output an arrival signal, this would likely mean that the flow rate of fluid out of the well head and through the return circuit passing through the plunger catcher 150 was not sufficient to carry the plunger up into a fully seated position within the plunger catcher 150. This would be an indicate that the choke mechanism should be reset to advance the distal end 149 of the choke member 147 further into the production passageway 118 of the manifold 110 to increase the flow rate of fluid through the return circuit passing through the plunger catcher 150.

Figure 9:
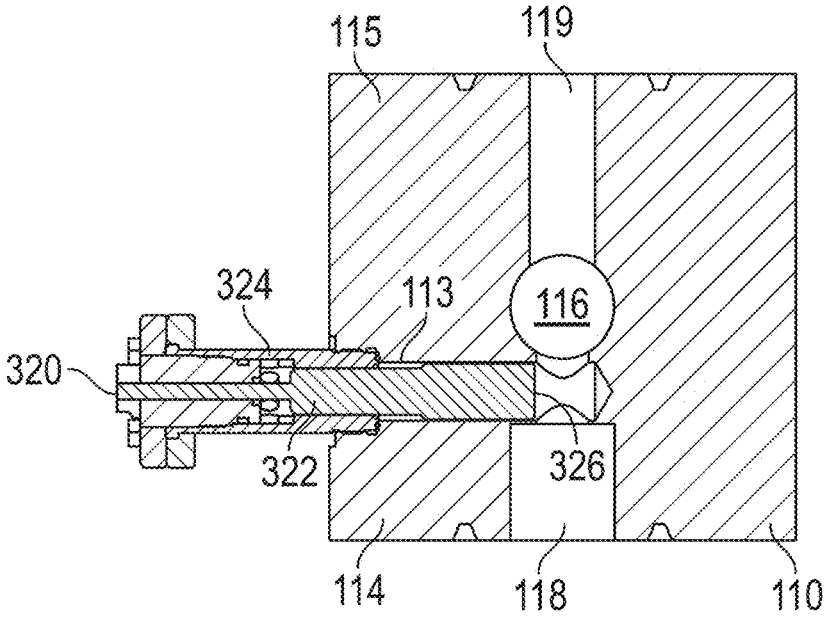
FIG. 9 is a partial cross-sectional view of the manifold of the manifold and plunger catcher mechanism illustrated in FIGS. 6 and 7 taken along section line 9-9 in FIG. 7.
Figure 10:
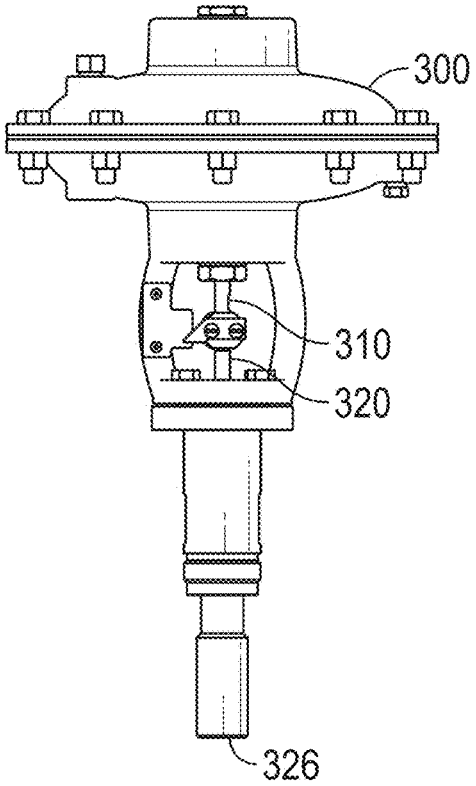
FIG. 10 is a top view of the pneumatic or hydraulic actuator of the manifold and plunger catcher mechanism illustrated in FIGS. 6 and 7.
Figure 11:
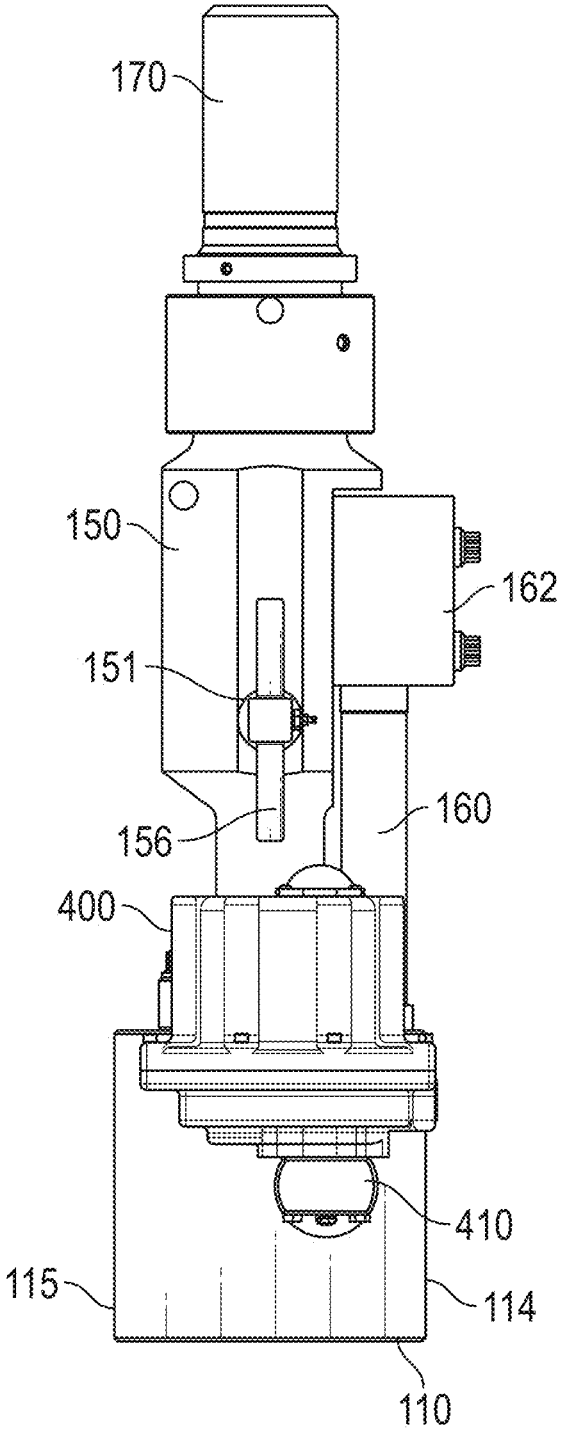
FIG. 11 is a front view of a manifold and plunger catcher mechanism with an electrically operated choke mechanism.
Figure 12:
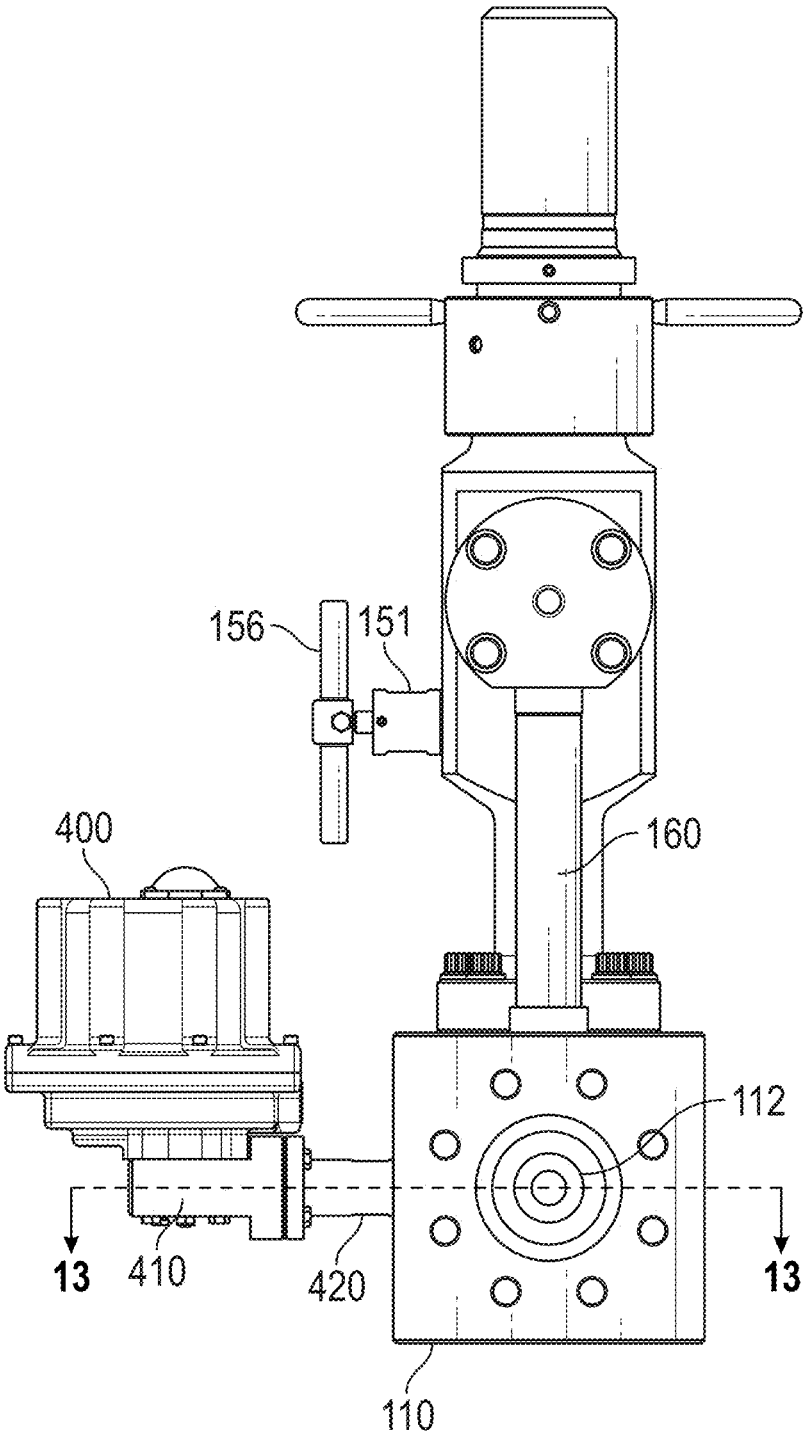
FIG. 12 is a right-side view of the manifold and plunger catcher mechanism illustrated in FIG. 11.
Figure 13:
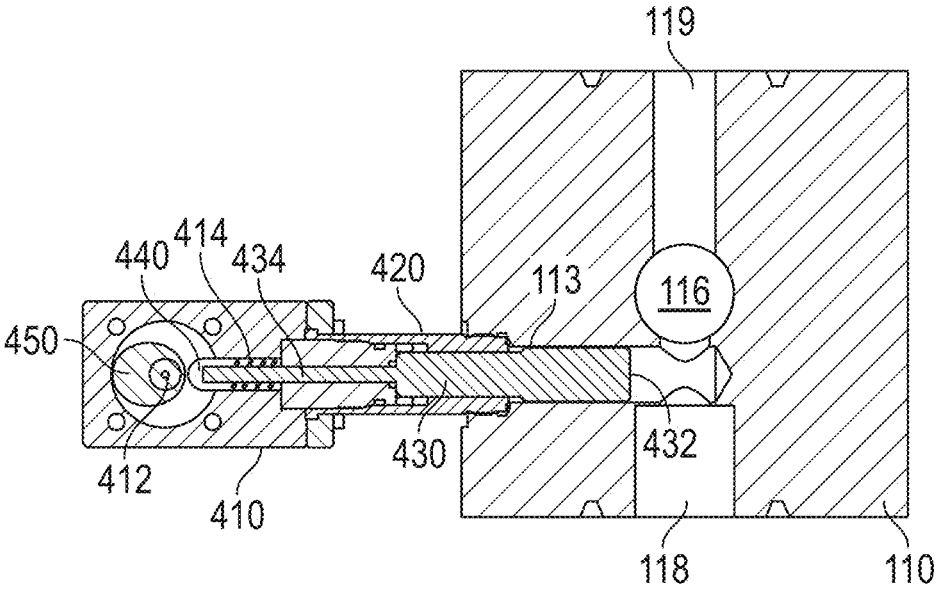
FIG. 13 is a partial cross-sectional view of the manifold of the manifold and plunger catcher mechanism illustrated in FIGS. 11 and 12 taken along section line 13-13 in FIG. 12.
Figure 14:
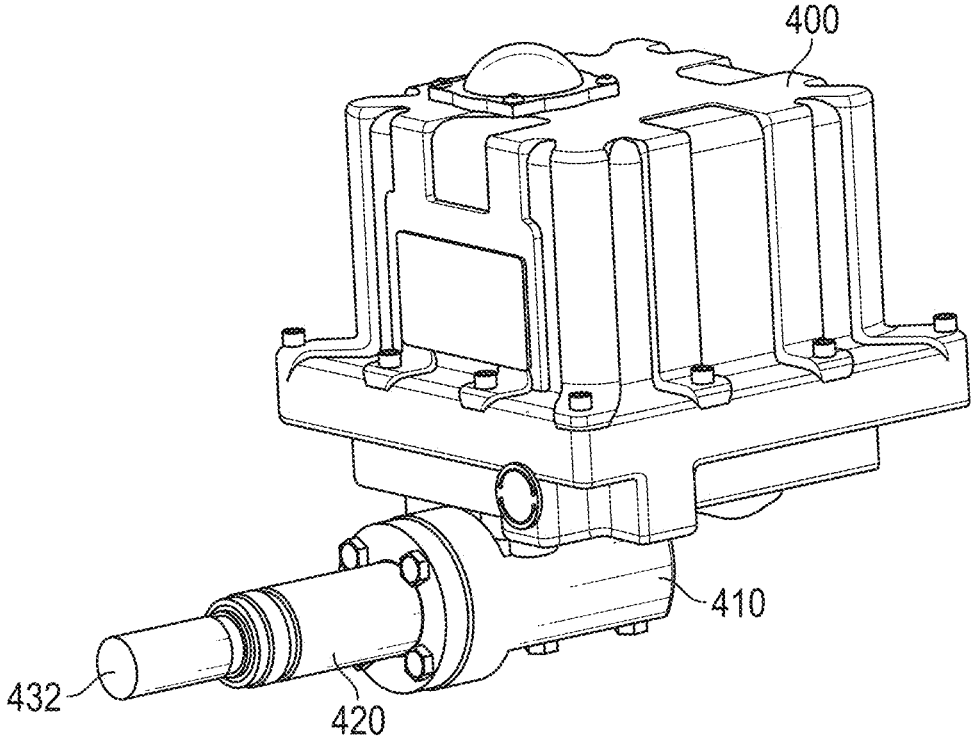
FIG. 14 is a perspective view of the electrically operated choke mechanism of the manifold and plunger catcher mechanism illustrated in FIGS. 11 and 12.

FIGS. 7-10 illustrate an alternate embodiment in which the manually operated choke mechanism illustrated in FIGS. 1-5 is replaced with a choke mechanism that is operated by a pneumatic or hydraulic actuator 300. As illustrated in FIG. 9, the choke mechanism still includes a choke member 322 slidably mounted in the choke passageway 113 of the manifold 110. A choke mount collar 324 is mounted to the exterior sidewall of the manifold 110. A proximal end 320 of the choke member 322 extends from the choke mount collar 324. The proximal end 320 of the choke member 322 is coupled to an actuator member 310 of the pneumatic/hydraulic actuator mechanism 300. The pneumatic/hydraulic actuator mechanism 300 can operate to cause the distal end 326 of the choke member 322 to extend into and retract from the production passageway 118 of the manifold 110 in essentially the same way as the first embodiment discussed above. Thus, pneumatic/hydraulic actuator 300 can be used to selectively vary the flow rate of fluid through the return circuit passing through the plunger catcher 150.

FIGS. 11-14 illustrate another embodiment that includes an electrically operated choke mechanism. In this embodiment, a choke mount collar 420 is mounted to a sidewall of the manifold 110, and a choke member 430 is slidably mounted in the choke mount collar 420 and the choke passageway 113 of the manifold 110. The distal end 432 of the choke member 430 can be advanced into and retracted from the production passageway 118 of the manifold 110 by the electrically operated actuator 400.

A proximal end 434 of the choke member 430 is covered by a cam follower 440. A return spring 414 urges the choke member 430 into a retracted position, and also serves to keep the cam follower 440 pressed against a rotatably mounted cam 450. The cam 450 is located in a cam housing 410 and the cam 450 is mounted onto a rotating shaft 412 of an electric motor of the electrically operated actuator 400. When the motor rotates the cam 450, the surface of the cam 450 pushes the cam follower 440 and the choke member 430 further into the manifold 110 so that the distal end 432 of the choke member 430 protrudes into the production passageway 118 of the manifold 110. Thus, selectively operating the motor of the electrically operated actuator 400 allows one to control the extent to which the distal end 432 of the choke member 430 blocks the production passageway, and thus the flow rate of fluid through the return circuit passing through the plunger catcher 150.

In some embodiments, a controller coupled to an arrival sensor 202/204 and a seated sensor 206 could be used to automatically adjust the position of the choke member. If the controller does not receive a seated signal from the seated sensor 206 immediately after receiving an arrival signal from an arrival sensor 202, 204, this would indicate that the flow rate of fluid through the return circuit passing through the plunger catcher 150 was not sufficient to cause the plunger to fully seat in the plunger catcher 150. Under those conditions, the controller could send a signal to an actuator of a choke mechanism to cause a distal end of a choke member to protrude further into the production passageway 118 of the manifold 110. This would serve to increase the flow rate of fluid through the return passageway, thereby aiding the plunger in fully seating in the plunger catcher 150.

Conditional language, such as, "can," "could," "might," or "may," unless specifically stated otherwise, or otherwise understood within the context as used, is generally intended to convey that certain implementations could, but do not necessarily, include certain features and/or elements while other implementations may not. Thus, such conditional language generally is not intended to imply that features and/or elements are in any way required for one or more implementations or that one or more implementations necessarily include these features and/or elements. It is also intended that, unless expressly stated, the features and/or elements presented in certain implementations may be used in combination with other features and/or elements disclosed herein.

The specification and annexed drawings disclose example embodiments of the present disclosure. Detail features shown in the drawings may be enlarged herein to more clearly depict the feature. Thus, several of the drawings are not precisely to scale. Additionally, the examples illustrate various features of the disclosure, but those of ordinary skill in the art will recognize that many further combinations and permutations of the disclosed features are possible. Accordingly, various modifications may be made to the disclosure without departing from the scope or spirit thereof. Further, other embodiments may be apparent from the specification and annexed drawings, and practice of disclosed embodiments as presented herein. Examples disclosed in the specification and the annexed drawings should be considered, in all respects, as illustrative and not limiting. Although specific terms are employed herein, they are used in a generic and descriptive sense only, and not intended to the limit the present disclosure.

What is claimed is:

1. A choke mechanism for an oil or gas well manifold, comprising:

a choke mount configured to be attached to an exterior surface of an oil or gas well manifold that includes a choke passageway that extends from the exterior surface to a straight production passageway within the manifold, a longitudinal axis of the choke passageway being perpendicular to a longitudinal axis of the straight production passageway, wherein the choke mount is configured to be attached to the exterior surface of the manifold such that the choke mount surrounds or covers the choke passageway;

a choke member that is movably mounted in an internal bore of the choke mount, the choke member including a proximal end and a distal end; and a choke actuator coupled to the proximal end of the choke member, wherein the choke actuator can be used to cause the choke member to move in a longitudinal axial direction along the internal bare of the choke mount such that the distal end of the choke member moves in a direction perpendicular to the longitudinal axis of the straight production passageway and into the straight production passageway.

2. The choke mechanism of claim 1, wherein internal threads are formed on the choke mount, wherein external threads are formed on the choke member, and wherein the internal and external threads are used to movably mount the choke member to the choke mount such that rotation of the choke member relative to the choke mount causes the choke member to move in the longitudinal axial direction along the internal bore of the choke mount.

3. The choke mechanism of claim 2, wherein the choke actuator comprises a handle attached to the proximal end of the choke member, wherein the handle can be used to cause the choke member to rotate relative to the choke mount.

4. The choke mechanism of claim 1, wherein when the choke mount is attached to an exterior surface of a manifold of an oil or gas well such that the choke member is received in a choke passageway of the manifold, the choke actuator can be used to cause the choke member to move along the choke passageway between a retracted position at which the distal end of the choke member does not substantially protrude into the straight production passageway of the manifold and an extended position at which the distal end of the choke member protrudes into the straight production passageway to at least partially block the straight production passageway.

5. The choke mechanism of claim 1, wherein the choke actuator comprises a pneumatic or hydraulic actuator that is operatively coupled to the proximal end of the choke member such that the pneumatic or hydraulic actuator can cause the choke member to move in the longitudinal axial direction along the internal bore of the choke mount.

6. The choke mechanism of claim 5, wherein the pneumatic or hydraulic actuator comprises an actuator member that moves in an axial direction, the choke actuator further comprising:

an actuator housing that is removably attached to the choke mount, wherein the pneumatic or hydraulic actuator is attached to the actuator housing; and a coupling that attaches the actuator member to the proximal end of the choke member such that axial movement of the actuator member causes the choke member to move in the longitudinal axial direction along the internal bore of the choke mount.

7. The choke mechanism of claim 6, wherein the pneumatic or hydraulic actuator is configured to cause the actuator member to move in first and second axial directions such that the actuator member can cause the choke member to move in first and second longitudinal axial directions along the internal bore of the choke mount.

8. The choke mechanism of claim 5, wherein when the choke mount is attached to an exterior surface of a manifold of an oil or gas well such that the choke member is received in a choke passageway of the manifold, the pneumatic or hydraulic actuator can be used to cause the choke member to move along the choke passageway between a retracted position at which the distal end of the choke member does not substantially protrude into the straight production passageway of the manifold and an extended position at which the distal end of the choke member protrudes into the straight production passageway to at least partially block the straight production passageway.

9. The choke mechanism of claim 1, wherein the choke actuator comprises:

an actuator housing that is removably attached to the choke mount;

an electric motor having a rotating shaft, the electric motor being mounted to the actuator housing; and a drive mechanism that is operatively coupled to the rotating shaft of the electric motor and the proximal end of the choke member such that the electric motor can cause the choke member to move in the longitudinal axial direction along the internal bore of the choke mount.

10. The choke mechanism of claim 9, wherein the drive mechanism comprises a cam attached to the rotating shaft of the electric motor, wherein the cam is operatively coupled to the proximal end of the choke member such that rotation of the cam by the electric motor causes the choke member to move in the longitudinal axial direction along the internal bore of the choke mount.

11. The choke mechanism of claim 10, wherein the drive mechanism further comprises a cam follower that is interposed between the cam and the proximal end of the choke member.

12. The choke mechanism of claim 10, wherein rotation of the cam by the electric motor causes the choke member to move in a first longitudinal axial direction along the internal bore of the choke mount, the choke actuator further comprising a biasing member mounted on the actuator housing and operatively coupled to the choke member such that the biasing member urges the choke member in a second longitudinal axial direction along the internal bore of the choke mount, the second longitudinal axial direction being opposite the first longitudinal axial direction.

13. The choke mechanism of claim 12, wherein when the choke mount is attached to an exterior surface of a manifold of an oil or gas well such that the choke member is received in a choke passageway of the manifold, the electric motor can be used to cause the choke member to move in the first longitudinal axial direction along the choke passageway to an extended position at which the distal end of the choke member protrudes into the straight production passageway of the manifold to at least partially block the straight production passageway, and wherein the biasing member can cause the choke member to move in the second longitudinal axial direction along the choke passageway to a retracted position at which the distal end of the choke member does not substantially protrude into the straight production passageway.

14. A choke mechanism configured to be attached to an exterior surface of an oil or gas well manifold that includes a choke passageway that extends from the exterior surface of the manifold to a straight production passageway within the manifold, a longitudinal axis of the choke passageway being perpendicular to a longitudinal axis of the straight production passageway, the choke mechanism comprising:

a choke mount that is configured to be attached to the exterior surface of the manifold;

a choke member that is movably mounted in an internal bore of the choke mount, the choke member including a proximal end and a distal end; and a choke actuator coupled to the proximal end of the choke member, wherein the choke actuator can be used to cause the choke member to move in a longitudinal axial direction along the internal bore of the choke mount; and wherein when the choke mount is attached to the exterior surface of the oil or gas well manifold such that the choke mount surrounds or covers the choke passageway of the manifold, choke member is located in the choke passageway of the manifold, and wherein the choke member can move in the longitudinal axial direction between a retracted position at which the distal end of the choke member does not substantially protrude into the straight production passageway of the manifold and an extended position at which the distal end of the choke member protrudes into the straight production passageway to at least partially block the straight production passageway.

15. The choke mechanism of claim 14, wherein internal threads are formed on the choke mount, wherein external threads are formed on the choke member, and wherein the internal and external threads are used to movably mount the choke member to the choke mount such that rotation of the choke member relative to the choke mount causes the choke member to move in the longitudinal axial direction along the internal bore of the choke mount, wherein the choke actuator comprises a handle attached to the proximal end of the choke member, and wherein the handle can be used to cause the choke member to rotate relative to the choke mount.

16. The choke mechanism of claim 14, wherein the choke actuator comprises a pneumatic or hydraulic actuator that is operatively coupled to the proximal end of the choke member such that the pneumatic or hydraulic actuator can cause the choke member to move in the longitudinal axial direction along the internal bore of the choke mount.

17. The choke mechanism of claim 16, wherein the pneumatic or hydraulic actuator comprises an actuator member that moves in an axial direction, the choke actuator further comprising:

an actuator housing that is removably attached to the choke mount, wherein the pneumatic or hydraulic actuator is attached to the actuator housing; and a coupling that attaches the actuator member to the proximal end of the choke member such that axial movement of the actuator member causes the choke member to move in the longitudinal axial direction along the internal bore of the choke mount.

18. The choke mechanism of claim 14, wherein the choke actuator comprises:

an actuator housing that is removably attached to the choke mount;

an electric motor having a rotating shaft, the electric motor being mounted to the actuator housing; and a drive mechanism that is operatively coupled to the rotating shaft of the electric motor and the proximal end of the choke member such that the electric motor can cause the choke member to move in the longitudinal axial direction along the internal bore of the choke mount.

19. The choke mechanism of claim 18, wherein the drive mechanism comprises a cam attached to the rotating shaft of the electric motor, wherein the cam is operatively coupled to the proximal end of the choke member such that rotation of the cam by the electric motor causes the choke member to move in the longitudinal axial direction along the internal bore of the choke mount.

20. The choke mechanism of claim 19, wherein rotation of the cam by the electric motor causes the choke member to move in a first longitudinal axial direction along the internal bore of the choke mount, the choke actuator further comprising a biasing member mounted on the actuator housing and operatively coupled to the choke member such that the biasing member urges the choke member in a second longitudinal axial direction along the internal bore of the choke mount, the second longitudinal axial direction being opposite the first longitudinal axial direction.

* * * * *